United States Patent [19]

Diamond et al.

[11] Patent Number: 4,969,751

[45] Date of Patent: Nov. 13, 1990

[54] BAG EXPANDING MEANS

[75] Inventors: Sidney Diamond, Chicago; Deborah L. Diamond, Northbrook, both of Ill.

[73] Assignee: Sidney Diamond, Niles, Ill.

[21] Appl. No.: 383,863

[22] Filed: Jul. 21, 1989

Related U.S. Application Data

[63] Continuation-in-part of Ser. No. 367,759, Jun. 19, 1989, Pat. No. 4,946,292.

[51] Int. Cl.[5] ..... B65D 30/00

[52] U.S. Cl. ..... 383/127; 190/106; 383/33

[58] Field of Search ..... 383/33, 35, 119, 127, 383/2; 248/174, 166, 440.1, 459, 464, 465; 190/103, 107, 105, 106

[56] References Cited

U.S. PATENT DOCUMENTS

| | | | |
|---|---|---|---|
| 1,738,208 | 12/1929 | Roberts | 248/174 |
| 1,822,297 | 9/1931 | Kemery | 248/174 |
| 2,283,406 | 5/1942 | Bacon | 248/174 |
| 2,798,579 | 7/1957 | Fox | 190/107 X |
| 3,300,166 | 1/1967 | Wojciechowski | 248/174 |
| 3,447,648 | 6/1969 | Schwennicke | 190/103 |
| 3,902,541 | 9/1975 | Wardwell | 383/119 X |
| 3,934,803 | 1/1976 | Paulus, Jr. | 383/33 X |
| 4,077,451 | 3/1978 | Zoland | 383/33 X |
| 4,141,399 | 2/1979 | Zoland | 383/104 X |
| 4,142,569 | 3/1979 | Zoland | 383/33 X |

*Primary Examiner*—Bryon P. Gehman

*Attorney, Agent, or Firm*—John S. Pacocha

[57] ABSTRACT

An expander for insertion into and expansion of a soft bag or backpack comprising a device which is folded or collapsed to a flat state or spread apart to an expanded state. In the flat position, the soft bag is collapsed to a compact form for shipment. In the expanded position, the bag is expanded to give the appearance that it is filled. In one embodiment, a resilient member automatically urges the device from a flat position to its expanded position when compressive forces are removed from the bag. In another form, a cord is used for manually moving the expander device into its bag-expanded position.

10 Claims, 7 Drawing Sheets

BAG EXPANDING MEANS

This is a continuation-in-part of Ser. No. 07/367,759, filed June 19, 1989.

FIELD OF THE INVENTION

This invention relates to means for and methods of expanding at the point of sale a soft bag, back-pack, or the like for display. More particularly, this invention relates to an apparatus which either automatically or manually expands a bag to give an impression that the bag is filled.

BACKGROUND OF THE INVENTION

For convenience of expression, the term "soft bags" is used herein to describe all suitable devices, such as suitcases, tote bags, sports bags, back-packs, and the like, in all sizes and types.

These soft bags are presently manufactured throughout the world and transported from the manufacturer to the destination of sale in a flatly packed or nested state so as to take up minimal shipping space because the costs involved in shipping stuffed bags are prohibitive. Freight charges from the point of manufacture to the destination of the bags are usually based on the amount of space that the bags occupy. For example, twelve back-packs nested and shipped flat occupy the same amount of space (approximately one cubic foot) that is occupied by one stuffed back-pack. Since most retailers prefer to display these soft bags in an expanded condition, a retailer often arranges for the bags to be stuffed and repacked at a stuffing facility located near the final destination or in some instances at the point of sale. The bags are removed from their original shipping cartons at the stuffing facility where the stuffing is done manually with such materials as crumpled paper, stiff cardboard pieces or inflated vinyl shapes. The original shipping cartons are then disposed of and replaced by larger cartons that will hold the fully stuffed bags.

Stuffing soft bags takes time, space, and additional personnel, which increases costs, causes inconvenience and sometimes delays delivery of the product to the point of sale. Additionally, the original shipping cartons are not reusable or recyclable and, therefore, must be discarded often requiring cartage companies, which charge a fee for waste removal and disposal at dump sites. Moreover, additional costs for the new larger cartons and additional freight charges are incurred for shipping the new cartons containing the stuffed bags to the retailer after the stuffing process is completed.

The retailer may confront storage problems since the stuffed bags take up much more storage space than unstuffed bags. Accordingly, the retailer may be inclined to order limited quantities of soft bags because of storage restrictions for fully expanded bags. Thus, there is a risk of a rapidly depleting inventory so that the retailer may be unable to reorder in time to fill the demand.

As a result of the problems associated with manually stuffed bags, some retailers have opted to display their bags while they are still flat and to include a picture of the bag as it appears when it is expanded. This method, however, is also costly and precludes the consumer from viewing the actual expanded bag.

Other retailers have contemplated having bags stuffed at the manufacturing point, but this is uneconomical because it requires more shipping space so that less bags can be shipped per container causing greatly increased shipping costs. Accordingly, an object of the present invention is to provide an insertable apparatus that permits a bag to be retained in a flattened state until expansion is desired and then allows the bag to be easily and quickly expanded by the retailer when the retailer desires to display the bag.

Another object of the present invention is to provide an insertable apparatus that is placed in the bag by the manufacturer or at the place of manufacture and is thereby more efficient and cost-effective since it allows the bag to be sent directly to the retailer, rather than to a stuffing facility, thus reducing delays in delivery time.

Another object of the present invention is to provide an insertable apparatus that requires minimum amount of material to manufacture and greatly reduces and conserves the usage of paper products or other stuffing materials, as well as the disposal of those materials.

Another object of the present invention is to provide an insertable apparatus that is placed in the bag during manufacture and then sent to the retailer in the original shipping container, in order to reduce freight charges and eliminate the need for an additional larger shipping container to house the stuffed bags.

Another object of the present invention is to provide an insertable apparatus for bags that requires a minimal amount of additional space in the shipping container and thereby enables retailers to order larger quantities and avoid inventory depletion.

A further object of the present invention is to provide an insertable apparatus which is relatively inexpensive to manufacture and which may be imprinted with advertising or other information directed to purchasers of the bag.

Additional objects and advantages will become apparent from the following description and the drawings.

SUMMARY OF THE INVENTION

One embodiment of the present invention comprises an apparatus having a relatively flat and foldable member, which may be connected to a resilient member or an actuating means. The flat member can be constructed of a suitably shaped piece (or pieces) of cardboard, corrugated board, or other suitable material, which is provided with at least one transverse foldline that divides the flat member into at least two sections. The flat member can be folded along the foldline to urge the two sections toward one another. The resilient member or actuating means can be a rubber band which is connected to the opposed ends of the flat member in substantially perpendicular relation to the foldline or axis about which the flat member is folded.

When the flat member is in its unfolded position, the rubber band is stretched. The memory of the resilient member thereby causes it to urge the ends of the flat member inward and this in turn causes the member to move into its folded position. Thus, the flat member will only remain in its unfolded position if a weight or some other external force is applied to it. When this apparatus is placed in a bag and no force is applied to the bag to retain the flat member in a flattened state, the member moves into its folded position, forms a gable, and pushes the sides of the bag outward to expand the bag. To insure more uniform expansion of the bag, generally rigid inserts, made of cardboard or other suitable material, may be added to the inventive apparatus. The inserts are placed on each side of the flat member in parallel relation thereto. When the flat member is folded into a gable it pushes against the cardboard inserts, which in turn push outwardly against the side of the bag. Since the inserts are preferably shaped to the dimensions of the sides of the bag, they will cause the bag to uniformly expand.

At the point of sale, the bag will automatically expand when it is removed from the shipping carton and the external force is removed from it. This saves time and promotes uniform expansion of each bag.

In another embodiment of this invention the flat member comprises three sections arranged in tandem: an elongated first section, a second section foldably attached to one end of the first section, and a third section foldably attached to the end of the second section which is opposite the end attached to the first section. The second and third sections are connected together with a resilient member, which is attached adjacent the ends of the sections and urges the sections toward one another in a manner similar to the first embodiment described earlier. An alternative of this embodiment employs an actuating means, such as a string, tape, or other suitable item, to pull the second and third sections toward one another. The string attaches to one end of the third section, passes through an aperture near the opposite end of the second section, and extends outside the mouth of the bag in which the apparatus of this invention is inserted. When expansion of the bag is desired, one may simply pull on the string. This in turn pulls the third section in the direction of the pulling force and causes the second and third sections to fold about the foldline dividing them and form a gable. The gable pushes the bag sides apart, causes air to be drawn into the bag, and thereby expands the bag. In both embodiments, a tab on the end of the third section may be provided for insertion into a slot on the first section when the structure is in its gabled bag-expanding position. This tab and slot arrangement provides stability to the structure and prevents retrograde movement. Also, if several slots are used the height of the gable may be adjusted to accommodate different sized bags. Similar to the first embodiment, additional flat inserts can be used with the apparatus to promote more uniform expansion of the bag.

Other embodiments of the invention achieve expansion of the bag without the need for forming a gable. In one example, three separate piece parts interrelate. Two of the pieces are relatively flat, rigid panels or boards that are adapted to press against the sides of bags. The other piece is disposed between the other two boards and functions as an actuator to push the two boards apart. This actuator may be a panel with at least one tab on each end, each of which fits into at least one corresponding slot in the adjacent outer panel. The actuator may operate either automatically under the urging of a resilient member, such as a rubber band, attached to the actuator, or manually with a string or cord attached to the actuator. When the assembly is in its flattened, compressed position with rubber bands stretched or the string slack, all of the pieces are flat.

When the resilient member or string cause the actuator to move, the actuator will become upright, push the two panels apart against the sides of the bag, and eventually lock in an erect expanded position when the tabs enter the appropriate slots.

The inventive apparatus can be easily inserted into the bags at the point of manufacture. When the resilient member is used, the bag can be shipped closed. When the string is used, a slight opening in the bag mouth is preferable, through which the string may extend. When the inventive apparatus is used, the bags need not be shipped to a stuffing facility near their final destination, thereby saving labor, stuffing and repacking costs, and eliminating delays in delivery and material waste. Since the bags containing the inventive device can be shipped flat, there is no appreciable increase in freight costs or the size of the shipping container. Moreover, the inventive device saves paper since less material would generally be used in the inventive device as compared with the material used in manually stuffing of the bags. The inventive device also eliminates the need for repacking and placing the bags into a second larger shipping container.

Because soft bags come in different sizes, shapes, and material thicknesses, the inventive apparatus can be varied to accommodate these differences. As maybe appropriate or desirable in each application, the various flat members or panels may be constructed in different lengths, widths, shapes, and strengths including elliptical, rectangular, or irregular shapes.

DETAILED DESCRIPTION OF THE INVENTION

Figure 1:
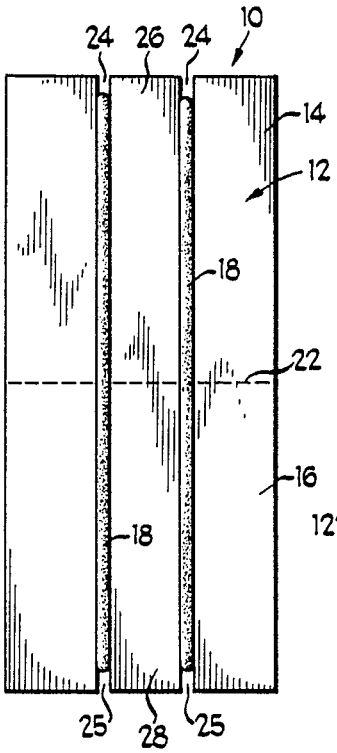
FIG. 1 is a bottom plan view of one embodiment of the invention, showing it in a flat position prior to insertion in a bag.
Figure 2:
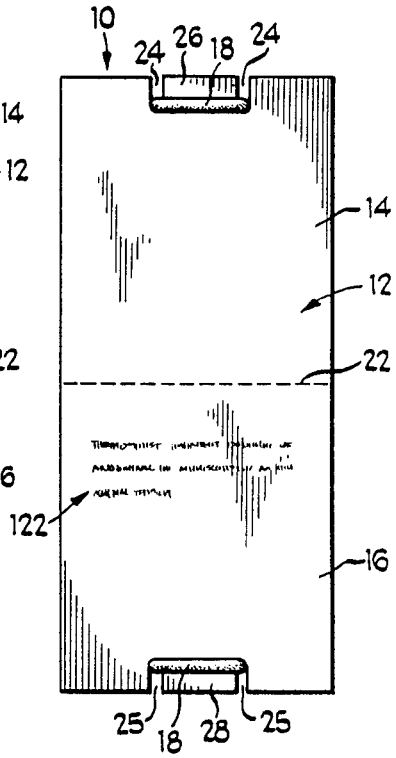
FIG. 2 is a top plan view of the embodiment of FIG. 1.
Figure 3:
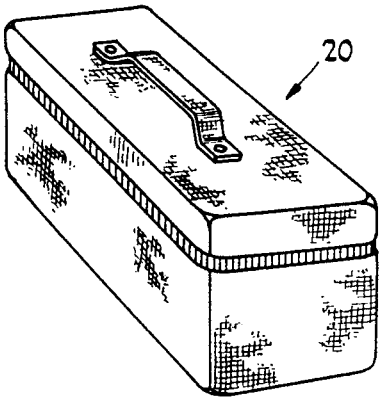
FIG. 3 is a perspective view of an exemplary soft bag as it appears after it is expanded by the inventive device.
Figure 4:
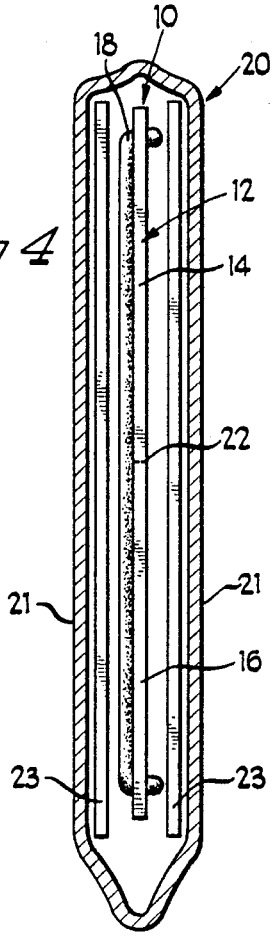
FIG. 4 is a cross-sectional view of the bag of FIG. 3 in a collapsed state, showing the embodiment of FIG. 1 in a flat position inside the bag.
Figure 5:
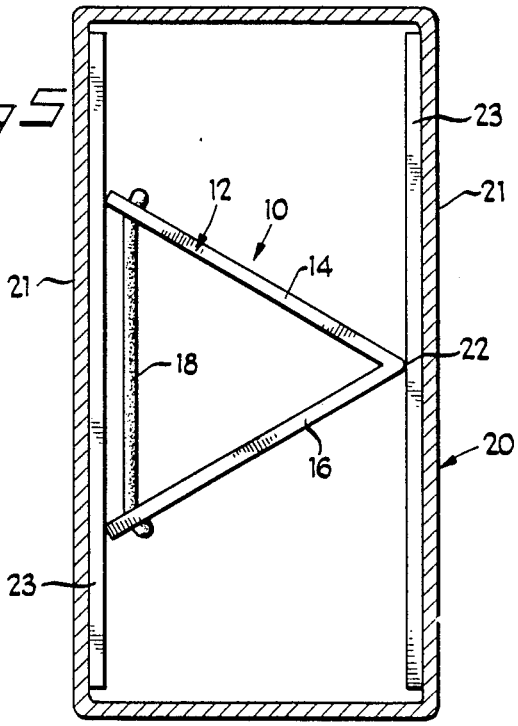
FIG. 5 is a cross-sectional view of the bag of FIG. 3 in an expanded state, showing the embodiment of FIG. 1 expanding the bag.

Referring to FIGS. 1–5, expander apparatus 10 comprises a generally flat member 12 and a resilient member 18 attached thereto. The flat member can be constructed of cardboard, corrugated board or of other suitable material by die cutting or other suitable manufacturing process. A fold line 22 is provided which divides member 12 into two preferably equal sections 14, 16 and permits member 12 to be folded along the line 22, which acts like a hinge, as shown for example in FIG. 5. The resilient member, which can be a rubber band or other elastic means, is attached to the first member by insertion into slots 24, 24 and 25, 25 and loops around tabs 26, 28 (FIGS. 1 and 2). When the member 12 is flat, the resilient member 18 is stretched and under tension. The memory of the member 18 causes it to urge the two sections 14, 16 of first member 12 towards one another. Thus, to keep the member 12 from folding along line 22, it is necessary to exert a force against member 12. When the apparatus 10 is inserted into a soft bag 20, as shown in FIG. 5, and the compressive force is removed from the bag, resilient member 18 causes sections 14, 16 to rotate about foldline or hinge 22 and move towards one another to form a gabled position. This in turn pushes cardboard inserts 23 apart and forces the sides 21 of bag 20 outwardly so that the bag expands. The cardboard inserts 23 are inserted into bag 20 on opposite sides of the member 12 (see FIG. 4) so that the inserts 23 are parallel to member 12. When the bag is expanded, as shown, e.g., in FIG. 5, the inserts 23 aid the bag 20 to expand uniformly.

Inserts 23 may be shaped and dimensioned to the bag in which they are to be used. This will normally give the best appearance to the bag when it is expanded. The inserts may also be provided in predetermined stock sizes as a matter of convenience and economy. The inserts can be eliminated in certain applications, such as small bags, or where the irregularities in the shape of the bags caused by the absence of the inserts is of no concern to the retailer.

During shipment from the manufacturer to a customer, soft bag 20 may be placed flat in a shipping container with other bags for shipment to retailers. The container normally will be completely filled with bags to maximize shipping space so if the bags contain the apparatus of this invention, the apparatus will be in a compressed state, as depicted in FIG. 4. When the bags are removed from the container, the compressive force will be relieved and the sections 14, 16 of apparatus 10 will move towards one another, pushing the walls of the bag outwardly, as shown in FIG. 5, and giving the bag a filled appearance. To increase the speed of expansion the bag may be opened slightly to allow air to enter into the bag.

FIGS. 6–9 show a second embodiment or expander 11, including a generally flat member 30 comprising three sections 32, 34 and 36 and a resilient member 38.

Figure 9:
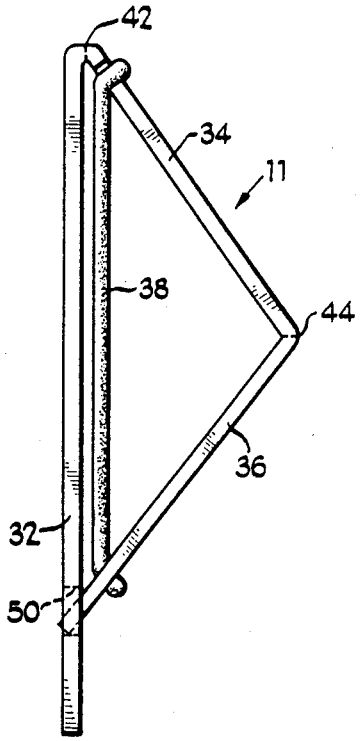
FIG. 9 is a side view of the embodiment of FIG. 6, showing the apparatus in a bag-expanding position.
Figure 6:
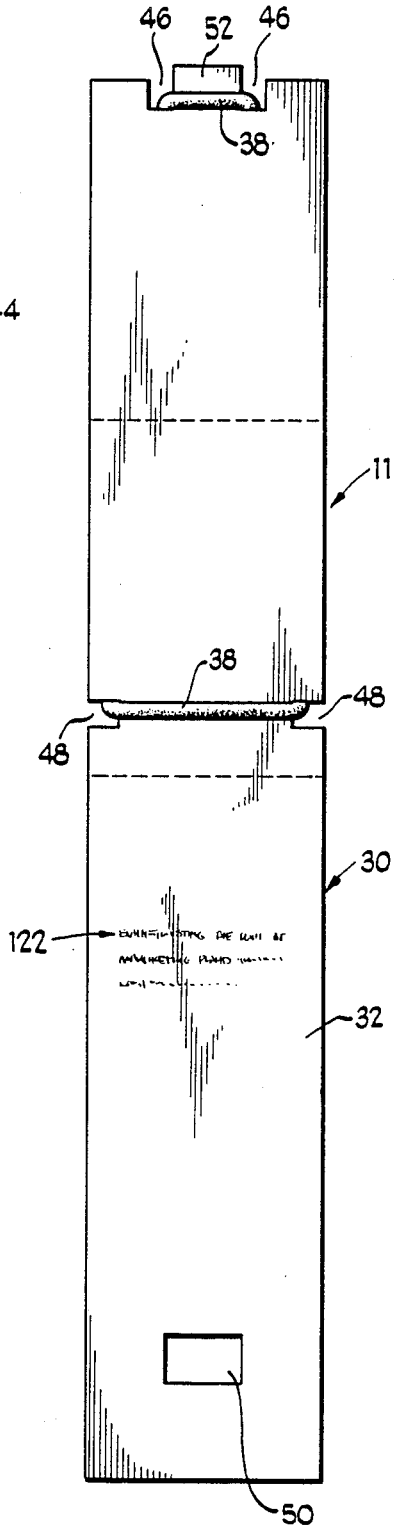
FIG. 6 is a top plan view of a second embodiment of the invention, shown in a flat unfolded position.
Figure 7:
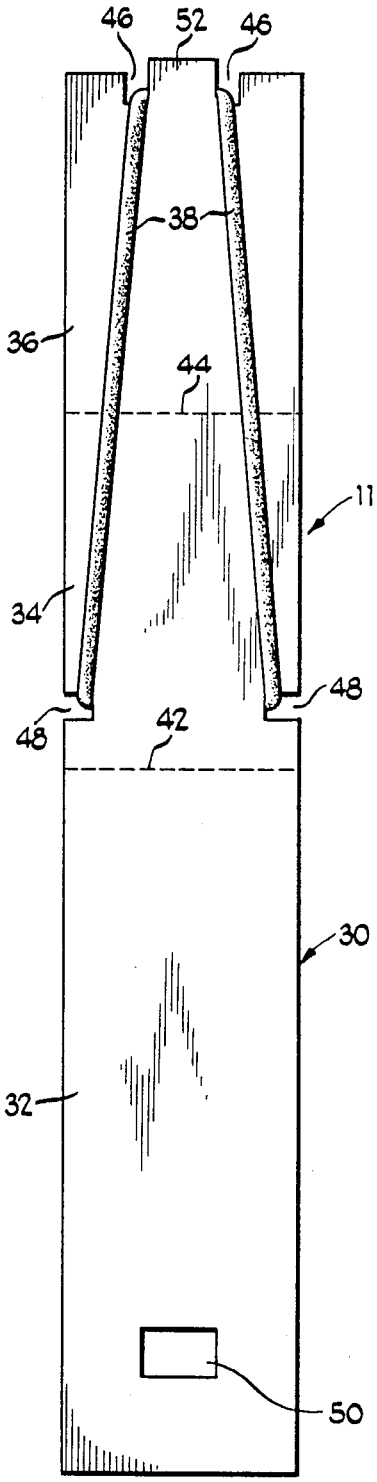
FIG. 7 is a bottom plan view of the embodiment of FIG. 6.
Figure 8:
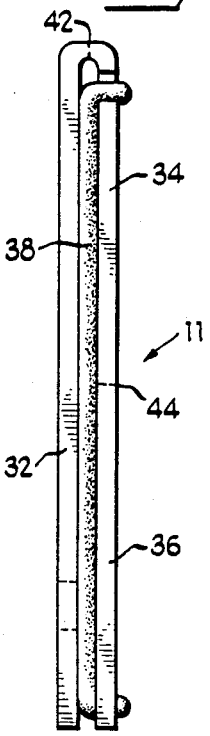
FIG. 8 is a side view of the embodiment of FIG. 6, illustrating the apparatus in a folded position with the resilient means stretched and under tension prior to insertion into an unexpanded bag.
Figure 12:
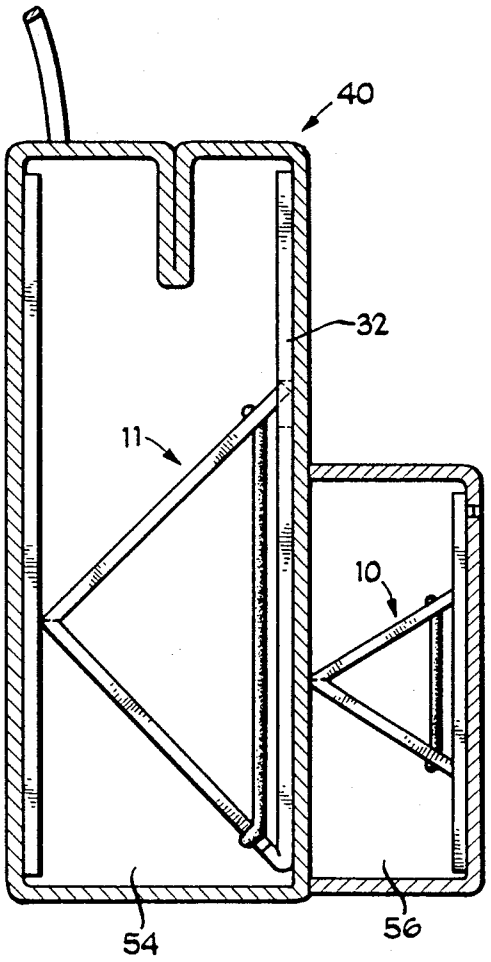
FIG. 12 is a cross-sectional view showing the embodiments of FIGS. 1 and 6, inserted into and expanding the two sections of the back pack.

Sections 32 34 and 36 are formed by folding member 30 along fold lines 42, 44. Slots 46, 48 are provided in member 30 for receiving and retaining member 38, as shown in FIGS. 6 and 7. To prepare the embodiment 11 for use in the bag, the member 30 is folded about foldline 42, as shown in FIG. 8. In this position resilient member 38 is stretched. So long as external compressive pressure is applied to the embodiment 11, it will be retained in the manner shown in FIG. 8. When the compressive pressure is released, the sections 34 and 36 will be folded about hinge or foldline 44 and pulled together by the resilient member 38 to form a gable, as shown in FIG. 9.

Member 30 includes a slot 50 located on section 32. Slot or keeper 50 receives tab 52 located on section 36 and secures sections 34, 36 in the gabled position shown in FIG. 9. This acts as a locking means and affords greater stability to the structure. The locking means prevents retrograde movement upon application of compressive forces. Should it be desired to collapse the structure, the tab 52 can be lifted from 50 and compressive forces applied to flatten the sections. As in the first embodiment, cardboard, corrugated board, or other suitable material may be used for member 30, and rubber bands or other suitable elastic means, for member 38.

Figure 11:
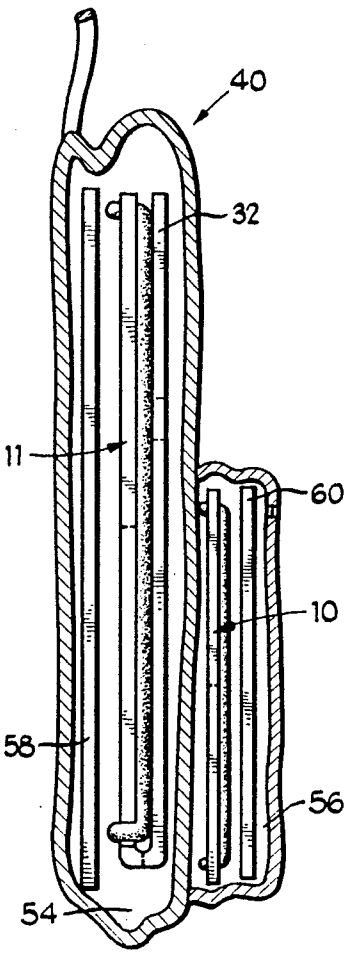
FIG. 11 is a cross-sectional view of the back pack of FIG. 10 in a collapsed state, illustrating the embodiments of FIGS. 1 and 6, inserted in flat positions in the back pack.
Figure 10:
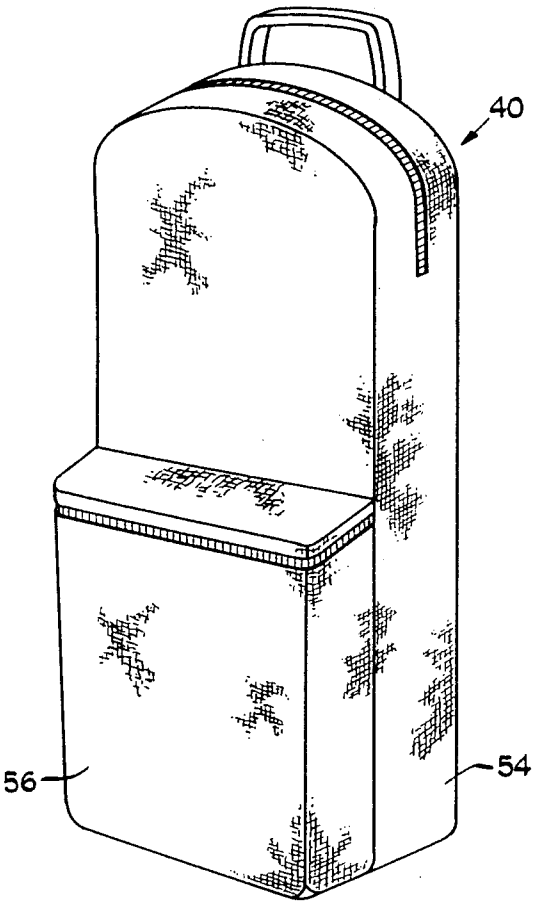
FIG. 10 is a perspective view of a back pack with a pocket.
Figure 13:
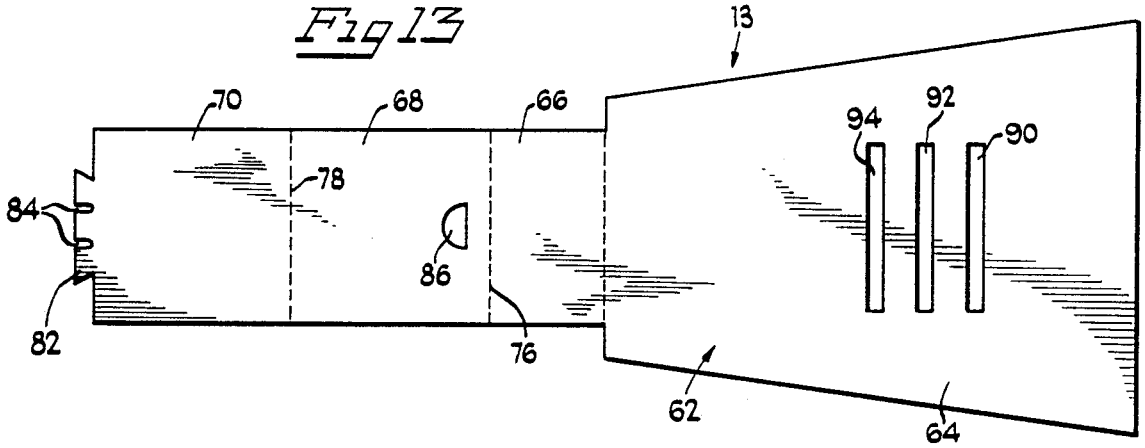
FIG. 13 is a plan view of a third embodiment of the invention, shown in an unfolded position.
Figure 14:
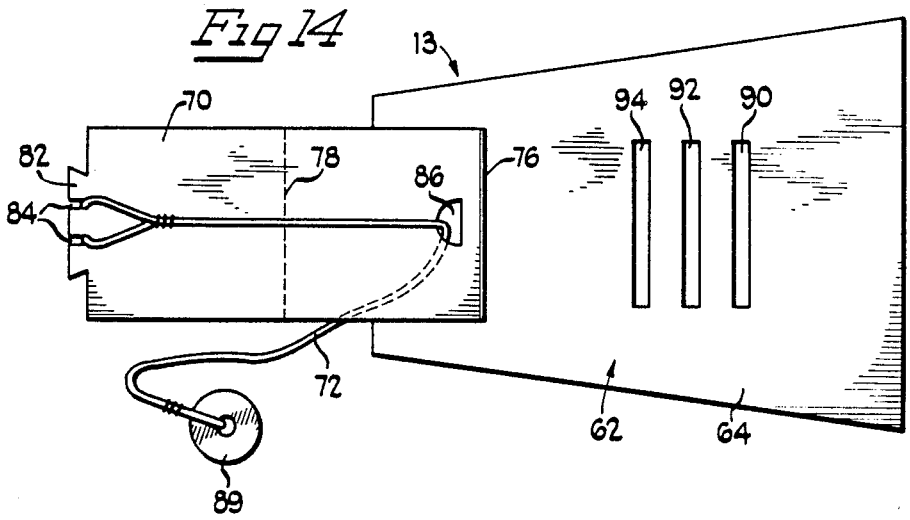
FIG. 14 is a plan view of the embodiment of FIG. 13, showing it in a partially folded position.

FIG. 10 shows a back pack 40 with two separate compartments 4, 56. FIG. 11 shows embodiments 10 and 11 as they would appear in a flattened configuration in the compartments 56 and 54, respectively. A single cardboard insert 58 is added to compartment 54, and a single insert 60 is added to compartment 56 of the bag 40. As in the other embodiments, these inserts assist in uniform expansion of bag 40. Because of the three-section configuration of embodiment 11, only one additional insert is necessary. Also, as can be seen in FIG. 11, only one insert is necessary for compartment 56 because section 32 of embodiment 11 accomplishes the function of an insert for that compartment, as well as compartment 54.

FIGS. 13–16 show a third embodiment 13 of the invention. Apparatus 13 has a generally flat member 62 comprising four sections 64, 66, 68 and 70 and an actuator member 72, which can be a string, tape, or other suitable device. The actuator member 72 need not be elastic, but should be long enough, so that when apparatus 13 is inserted into a bag, member 72 will extend out from the mouth of the bag.

Figure 15:
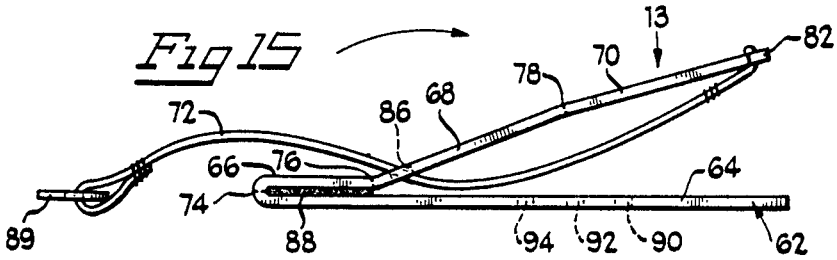
FIG. 15 is a side view of the embodiment of FIG. 13, showing the relative movement of the parts and their relationship to one another just prior to insertion into a bag.
Figure 16:
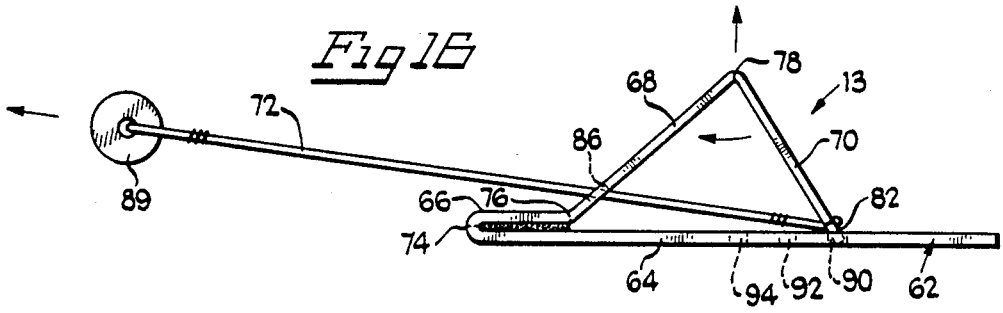
FIG. 16 is a side view of the embodiment of FIG. 13, showing further movement of the parts and their relationship to one another when the apparatus is actuated into its position for expanding a bag.
Figure 17:
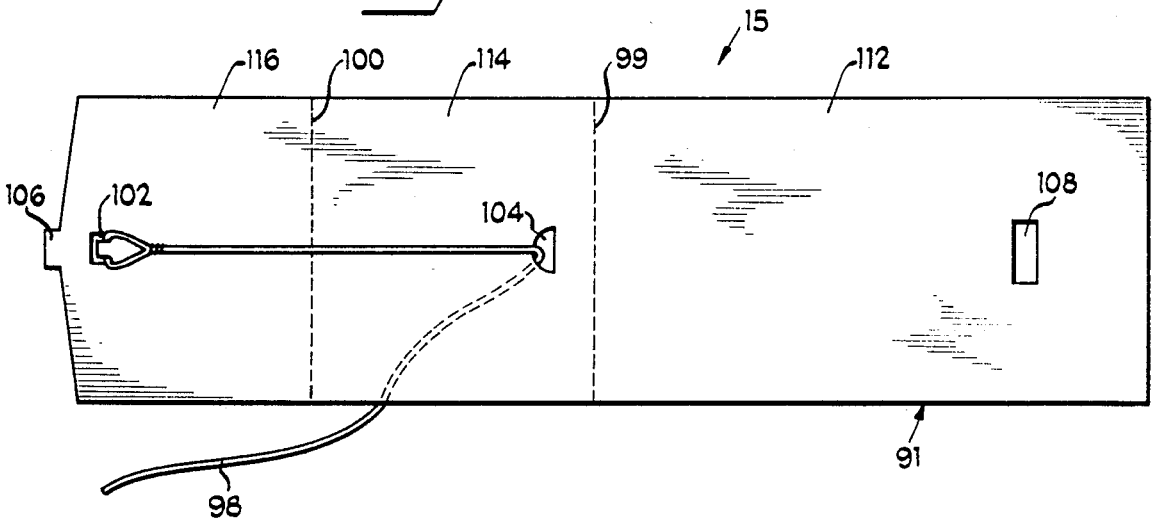
FIG. 17 is a plan view of a fourth embodiment of the invention, showing it in an unfolded position.

The four sections 64, 66, 68, 70 are formed by fold lines 74, 76 and 78, and are adapted to fold over onto section 64 (see, e.g., FIGS. 15 and 16). Section 66 is secured to section 64 at point 88 by an adhesive, adhesive tape, or other suitable fastening means (FIG. 15). Section 64 includes a plurality of slots 90, 92, 94, which are adapted to receive tab 82 of section 70. Tab 82 includes slots 84 which retain member 72 at one end. The remainder of member 72 is threaded through opening 86 in section 68 and terminates in a pull 89.

As shown in FIG. 16, member 72 is manually pulled to cause sections 68, 70 to move towards one another, while sections 64 and 66 remain in a flat position. As a result of the movement of sections 68, 70, the sides of the bag into which apparatus 13 is inserted are pushed outwardly to expand the bag in which the apparatus is inserted. The arrows in FIG. 16 show the inward and upward movement of sections 68, 70 of apparatus 13 as member 72 is pulled in the direction of the arrow. As section 70 slides over section 64, tab 82 of section 70 engages the first of the plurality of slots 90, 92, 94 of section 64. If member 72 is continued to be pulled, the tab 82 will move out of the first slot 90 and into the second one 92. Further pulling of member 72 will cause tab 82 to move out of the second slot and into the third slot 94. Insertion of tab 82 into any one of the slots 90, 92, 94 will secure section 70 and stabilize the apparatus 13. By providing a plurality of slots, the height of the gable may be varied, making the apparatus adjustable for bags having different sized gussets. Thus, if greater expansion is desired in the bag, tab 82 can be inserted into the slot 94; if lesser expansion is needed, slot 90 may be employed. Moreover, as with the expander 11, the locking means prevents retrograde movement upon application of compressive forces, and the structure can be collapsed by lifting the tab 82 out of any on of the slots and flattening the structure with compressive forces.

Member 62 of apparatus 13 may be formed from a single piece of material or from two pieces of material. Thus, instead of having fold line 74, apparatus 13 could be formed by securing two separate pieces together by adhesive 88 or another fastening means to form a hinge.

As noted earlier, actuating member 72 is designed to extend through the mouth and outside of the bag containing apparatus 13. In this application, the bag need only be opened in a manner sufficient to allow member 72 to protrude from the bag. While a pull or handle 89 is provided to facilitate manual manipulation, it is not essential. Instructions for operating the apparatus 13 or other information may be imprinted on the pull 89.

Figure 18:
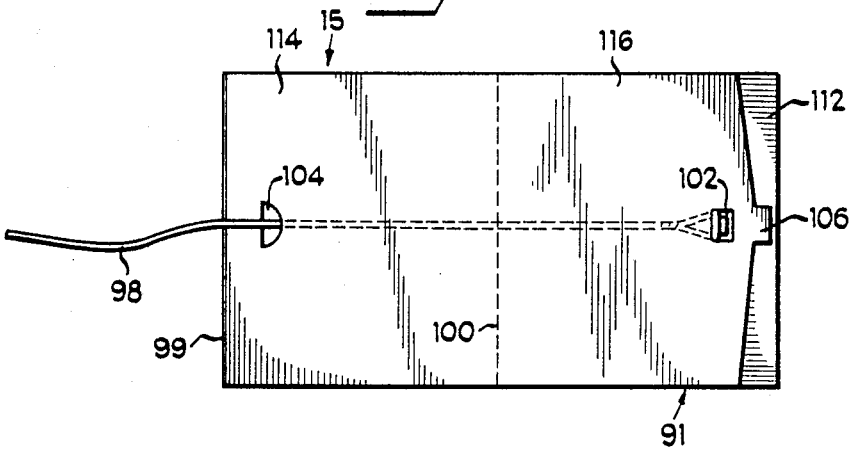
FIG. 18 is a plan view of the embodiment of FIG. 17, showing it in a flat folded position for insertion into a bag prior to expansion.
Figure 19:
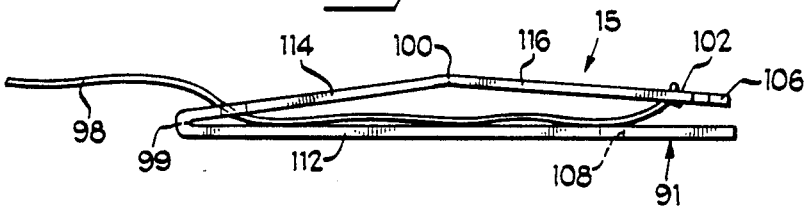
FIG. 19 is a side view of the embodiment of FIG. 17, showing it in a relatively flat, folded position similar to FIG. 18.

FIGS. 17–20 show a fourth embodiment 15 of the invention. Apparatus 15 is similar to apparatus 13, but does not have sections that are secured to each other by adhesive means. Apparatus 15 has a flat elongate member 91 comprising three sections 112, 114, 116 arranged in tandem and an actuator member 98. As in the other embodiments, member 91 may be constructed of corrugated board, cardboard or other suitable material. Member 98 may be a string, tape, plastic wire, or the like, and can be designed to extend outside of the soft bag containing apparatus 15. Sections 112, 114, 116 are formed by fold lines 99, 100 located on member 91. Sections 114 and 116 are adapted to fold about foldline 99 and over onto section 112, as shown in FIGS. 18 and 19. Actuator member 98 is secured to section 116 in slot 102 and extends through an opening 104 in section 114. A tab 106 is provided in section 116 for engaging slot 108 of section 112.

Figure 20:
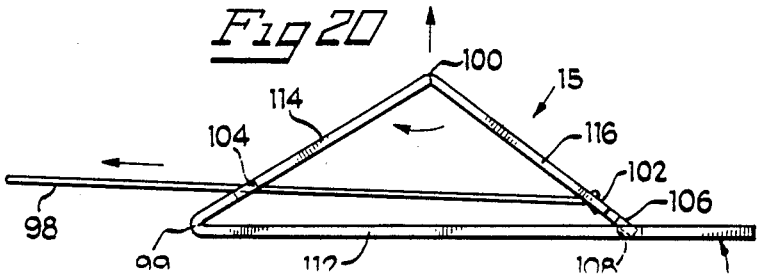
FIG. 20 is a side view of the embodiment of FIG. 17, showing movement of the parts and their relationship to one another when the apparatus is actuated into its position for expanding a bag.
Figure 21:
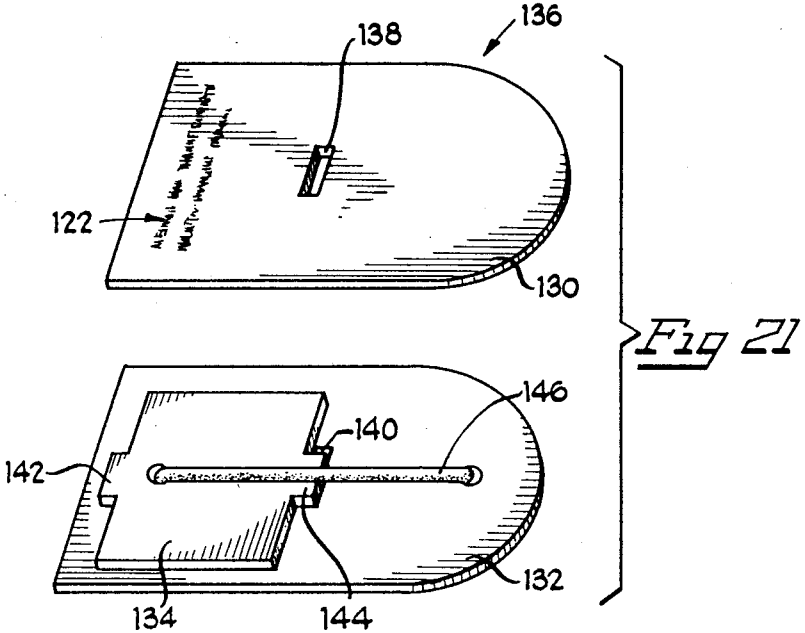
FIG. 21 is an exploded perspective view of a fifth embodiment of the invention, employing automatic expanding means.
Figure 23:
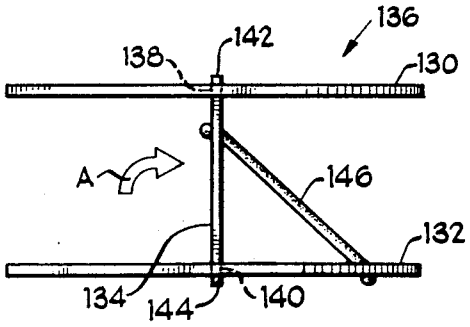
FIG. 23 is a side view of the embodiment of FIG. 21 showing the apparatus in an expanded and locked condition.

FIGS. 18 and 19 show apparatus 15 as it appears generally flat for insertion into a bag. As shown in FIG. 20, pulling actuator member 98 in the direction of the arrow causes section 116 to move over section 112 and towards section 114. This forms a gable that pushes the sides of a bag outwardly, and thereby expands the bag. Tab 106 of section 116 engages opening 108 of section 112 and is thereby securely retained, affording stability to apparatus 15. This structure may be collapsed by lifting tab 106 out of the opening 108 and applying a compressive force to the gable. If desired, several openings similar to opening 108 may be added to provide adjustability of the device.

Actuator member 98 can be designed to extend outside of the bag containing apparatus 15 in the same manner as is described for apparatus 13.

Figure 22:
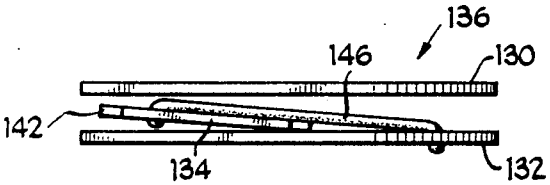
FIG. 22 is a side view of the embodiment of FIG. 21 in a flattened condition prior to insertion into a soft bag.
Figure 24:
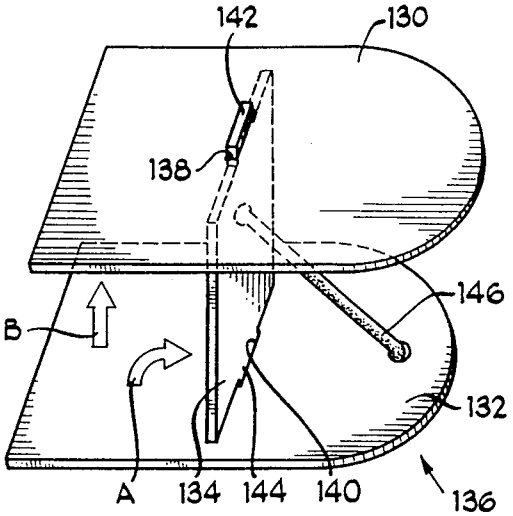
FIG. 24 is a perspective view of the embodiment of FIG. 21 showing the apparatus in an expanded and locked position.
Figure 25:
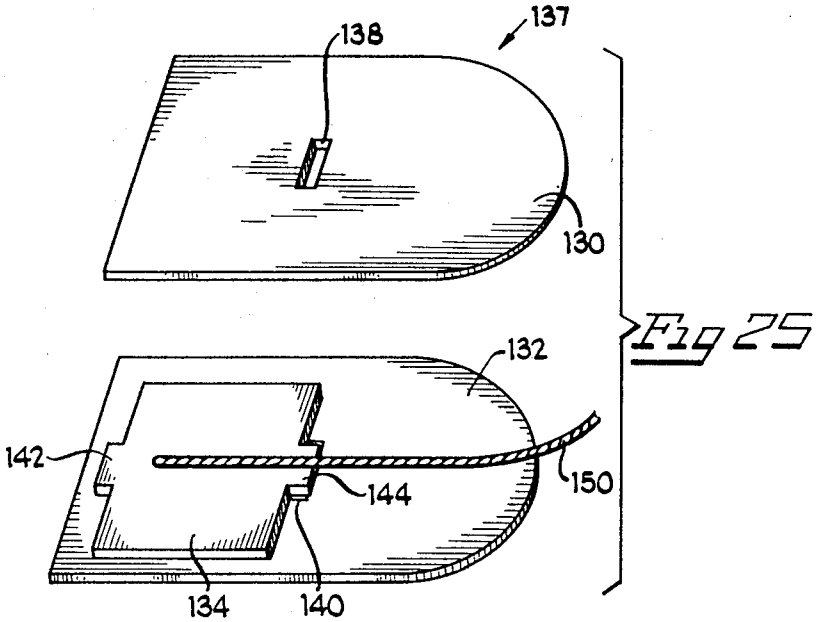
FIG. 25 is an exploded perspective view of a sixth embodiment of the invention, employing manual expanding means.
Figure 27:
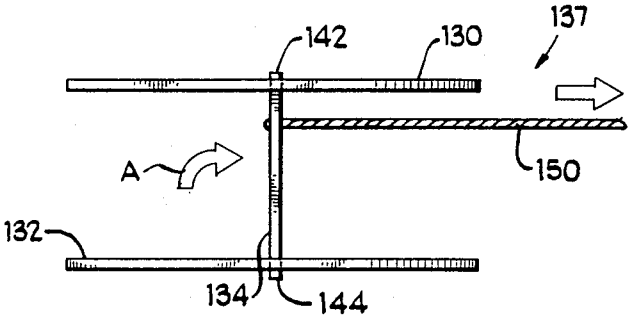
FIG. 27 is a side view of the embodiment of FIG. 25, showing the apparatus in an expanded and locked position.
Figure 26:
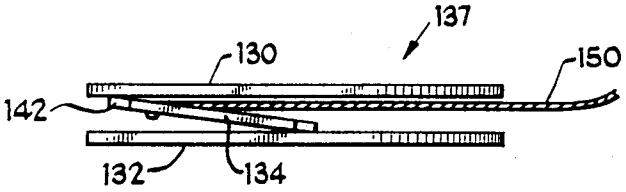
FIG. 26 is a side view of the embodiment of FIG. 25 in a flattened condition prior to insertion into a soft bag.
Figure 28:
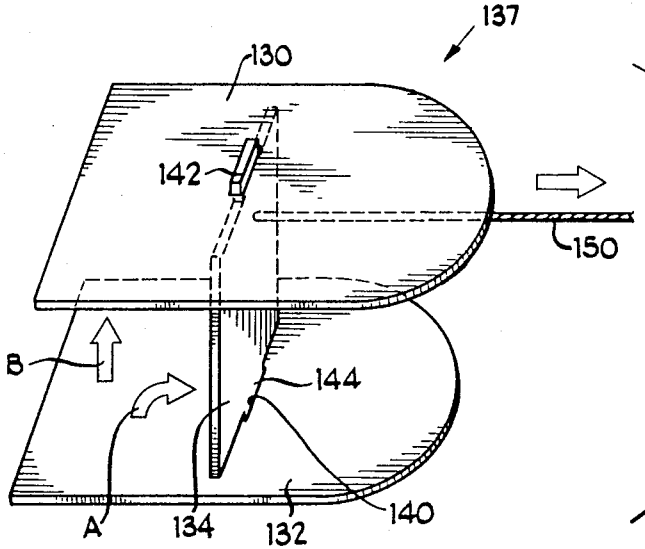
FIG. 28 is a perspective view of the embodiment of FIG. 25, showing the apparatus in an expanded and locked position.

Further embodiments 136 and 137 are shown in FIGS. 21–28, each of which includes three completely separate pieceparts 130, 132 and 134. The embodiment 136 of FIGS. 21–24 differs from the structure 137 of FIGS. 25–28 in that it employs a resilient member 146 and functions automatically, whereas the latter employs a cord or string 150 and functions manually. The outer panels 130, 132 contain keepers or slots 138, 140, respectively. The central or actuator panel 134 of each embodiment has a pair of oppositely disposed tabs 142, 144 thereon. As shown in FIGS. 21–25, e.g., resilient member 146 is secured to panels 132 and 134. Tab 144 normally fits into the keeper or slot 140 and is held there under the pull of the resilient member 146 while the structure 136 is in its collapsed state (FIG. 22). When the compressive forces are removed from the structure 136, the resilience of member 146 pulls the central or actuator panel 134 to an upright position in the direction shown by the arrow A in FIGS. 23 and 24. This pushes panel 130 away from panel 132, as shown by arrow B in FIG. 24. The tab 142 fits into keeper or slot 138 and holds the two outer panels 130, 132 in a locked, separated state.

In the embodiment 137 of FIGS. 25–28, the parts 130–134 are the same as correspondingly numbered parts in FIGS. 21-24, and function in the same way. In this embodiment, a manual operating device 150, secured to panel 134, is provided to pull the panel 134 to an upright position in the direction shown by the arrow A in FIGS. 27 and 28. Device 150 is a cord, string or the like. Once panel 134 is in position, it holds the outer panels 130, 132 in a locked separated position, which expands a soft bag. The relative movement of the panels 130 and 132 caused by the movement of the actuator panel 134 is shown by arrow B in FIG. 28.

If it is desired to collapse the structure of either embodiment 136 or 137 from an upright position, the tab 142 may be disengaged from slot 138 and the parts 130, 132 and 134 collapsed to their flattened state.

The panels 130, 132 are shaped to fit into a soft bag having the contours of a satchel, such as an athletic bag, for example. Thus, the term "outer panel" or the like should be construed as "having any suitable" shape. One might well imagine a clam shell shape and other unique shapes, which may be accommodated in a similar manner.

Because the inventive apparatus is made from flat paperboard stock or similar material, it may carry printed information 122, such as advertising, bag care instructions, or decorative indicia. In this way, the bag expanding means of this invention can be used to deliver messages to the ultimate purchasers of the bags.

While specific embodiments have been described, all modifications and equivalents of such embodiments which fall within the principles of the invention are intended to be covered by the appended claims; and the claims should therefore be construed to cover all such equivalents falling within the spirit and scope of the invention.

The invention claimed is:

1. An expanding device in combination with and for insertion within a soft bag of the type having a collapsed condition and an expanded condition comprising:

a first side and a generally opposite second side at least partially forming the soft bag;

a first rigid insert for bearing against the first side of said bag;

a second rigid insert for bearing against the second side of said bag;

each of the inserts has a slot;

an expander positioned between said inserts and including at least one rigid section;

the expander having a pair of oppositely disposed tabs;

an elastic means attached to the at least one section of said expander for automatically moving said inserts from a relatively flat position in which said expander and said inserts are positioned in a generally parallel relationship, to a bag-expanding position in which said expander is at an angle with respect to said first and second inserts to separate the first and the second inserts in order to expand said soft bag;

one of the tabs being held in engagement with one of the slots by the elastic means when the expander and the inserts are positioned in the generally parallel relationship; and upon the elastic means automatically moving the expander to separate the inserts, each of the tabs fitting into a respective one of the slots to hold the inserts in a locked, separated state.

2. The expanding device and soft bag combination of claim 1 wherein said inserts are shaped and dimensioned to fit the respective sides of said bag.

3. The expanding device and soft bag combination of claim 1 wherein said expanding device is adapted to carry printed indicia.

4. The expanding device and soft bag combination of claim 1 in which:

the expander and the inserts are held in the generally parallel relationship by compressive forces applied to the bag; and the elastic means automatically moves the expander and inserts to the bag expanding position when the compressive forces are removed from the bag.

5. The expanding device and soft bag combination of claim 1 including a supple material joining said sides, said bag being movable between a collapsed condition, and an expanded condition in which said sides are spaced from each other and said material is extended.

6. The expanding device and soft bag combination of claim 1 in which the expander stably holds the inserts in a separated position.

7. The expanding device and soft bag combination of claim 1 in which the elastic means is attached between the at least one section of the expander and one of the inserts.

8. The expanding device and soft bag combination of claim 1 in which the expander is substantially perpendicular to each of the inserts.

9. A bag expanding device in combination with a soft bag comprising:

a pair of opposed portions partially forming the bag;

means connected between the portions and together with the portions defining a compartment expandable to a predetermined shape;

one or more of the means and the portions being soft and flexible so that the compartment may be readily collapsed into a substantially flattened state or expanded into a substantially stuffed state in which the portions are spaced apart from each other to substantially the full extent permitted by the predetermined shape of the expanded compartment;

the expanding device including a first generally planar, rigid insert;

the expanding device also including a second generally planar, rigid insert;

the expanding device additionally including a generally planar expanding piece positioned between the inserts in an initial, substantially parallel relationship;

the expanding device further including a resilient member attached between the expanding piece and one of the inserts;

the resilient member being in tension when the expanding piece and the inserts are in the substantially parallel relationship;

the expanding piece being inserted within the compartment with the first insert adjacent to the one portion and the second insert adjacent to the other portion in the initial, substantially parallel relationship and being retained in that initial, substantially parallel relationship by a compressive force; and the resilient member automatically urging the expanding piece into a bag expanding position in which the expanding piece is at an angle to each of the inserts to the extent permitted by the predetermined shape of the expanded compartment upon removal of the compressive force.

10. The bag expanding device in combination with a soft bag of claim 9 in which:

each of the portions has a respective predetermined outline;

the first generally planar, rigid insert substantially conforms in outline to the one portion; and the second generally planar, rigid insert substantially conforms in outline to the other opposed portion.

* * * * *